United States Patent [19]

Fukukura

[11] 4,356,358

[45] Oct. 26, 1982

[54] MEMBRANE SWITCH

[75] Inventor: Kazutoyo Fukukura, Reading, Mass.

[73] Assignee: AMP Incorporated, Harrisburg, Pa.

[21] Appl. No.: 279,289

[22] Filed: Jul. 1, 1981

[51] Int. Cl.[3] ..... H01H 13/52

[52] U.S. Cl. ..... 200/5 A; 200/159 B; 200/292

[58] Field of Search ..... 200/5 A, 307, 86 R, 200/159 B, 292, 83 N

[56] References Cited

U.S. PATENT DOCUMENTS

| | | | |
|---|---|---|---|
| 3,987,259 | 10/1976 | Larson | 200/159 B X |
| 3,996,427 | 12/1976 | Kaminski | 200/5 A |
| 3,996,429 | 12/1976 | Chu et al. | 200/5 A |
| 4,066,851 | 1/1978 | White et al. | 361/398 X |
| 4,246,452 | 1/1981 | Chandler | 200/6 A X |
| 4,284,866 | 8/1981 | Bryce et al. | 200/159 B |

*Primary Examiner*—A. T. Grimley
*Assistant Examiner*—Morris Ginsburg
*Attorney, Agent, or Firm*—Frederick W. Raring

[57] ABSTRACT

A membrane switch device is described which is composed of two membrane switch arrays which are in parallel closely spaced relationship. A first or original array of membrane switches is provided on a sheet of flexible insulating film which has been folded about a medial fold line so that the switch electrodes on the two opposed surfaces are in alignment. The electrodes have conductors extending therefrom which extend onto a tail. A second array is provided on an extension of the sheet of insulating film and this extension also is folded about its own medial fold line. Additional electrodes and conductors are provided on the extension. A slit is formed between the original section of film and the additional section and the tail is inserted through this slit when the first array is produced by folding the first or original section of film. After the second section or extension of the film is folded to produce the second array of switches, the entire second switch array is folded as a unit towards the first array so that both switch arrays are adjacent to each other and are in parallel planes.

8 Claims, 9 Drawing Figures

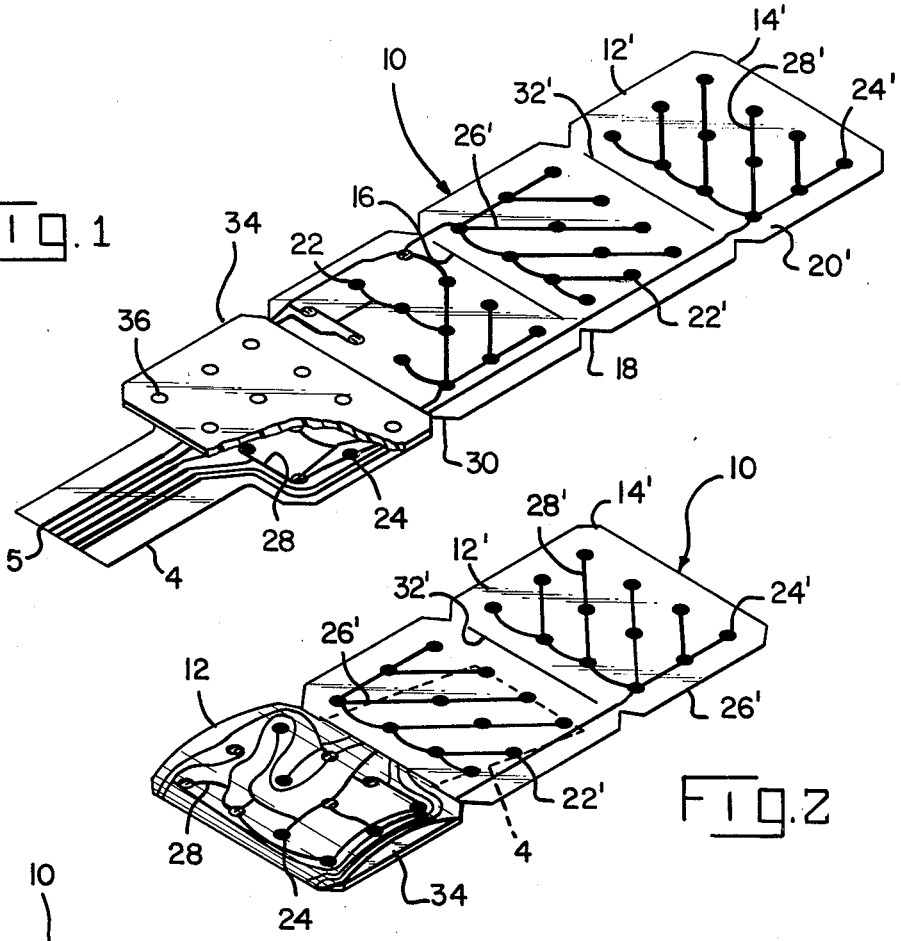
FIG. 1
FIG. 2
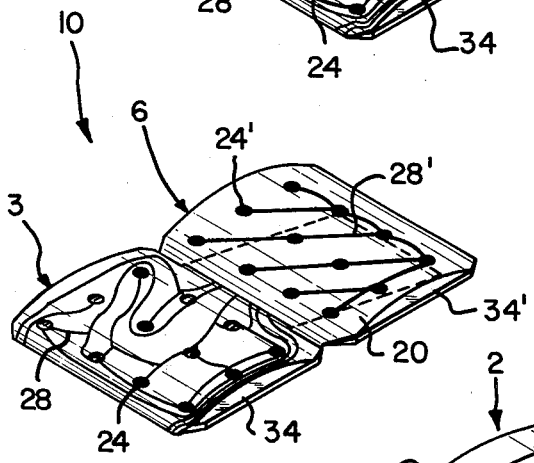
FIG. 3
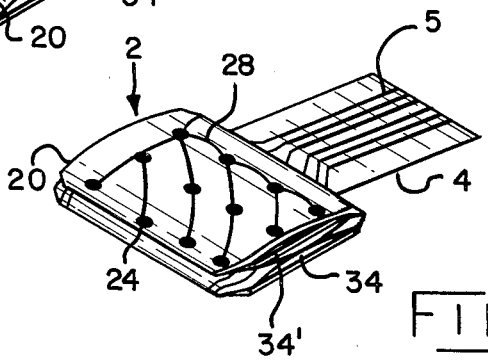
FIG. 4

MEMBRANE SWITCH

FIELD OF THE INVENTION

This invention relates to membrane switch devices of the type comprising a sheet of insulating film which has been folded about a medial fold line and which has switch electrodes and conductors on the opposed surfaces so that a circuit can be completed by flexing the film and moving two electrodes against each other. The invention is particularly directed to a membrane switch device having two separate switch arrays in parallel relationship to each other.

BACKGROUND OF THE INVENTION

U.S. Pat. No. 4,066,851 describes a membrane switch device comprising a rectangular sheet of insulating film which has been folded about a medial fold line so that it has opposed surfaces on which switch electrodes and switch conductors are provided. A separator is positioned between the surfaces and an individual circuit can be completed by pressing on the film to move the desired electrodes towards each other and close a predetermined circuit. U.S. Pat. No. 4,066,851 describes a convenient manufacturing method for producing membrane switches. The switch electrodes and the switch conductors are formed, as by printing a conductive ink, on one surface of a flexible film. The film is then folded along a medial fold line so that two surfaces are opposed to each other, the opposed surfaces having the conductors and electrodes thereon. The conductors on the film usually extend to a tail and can be connected from this tail to further circuit conductors by means of a connector or by soldering.

It is sometimes desirable to use membrane switches as double-pole, double-break switches so that when an individual switch site is pressed, two electrical circuits are completed as shown in U.S. Pat. No. 3,917,917. The double-pole, double-break switches of the 3,917,917 patent are formed by use of three individual insulating films which must be assembled to each other by suitable fasteners, such as screws or rivets, to form the assembly. It would be desirable to be able to manufacture a membrane switch device having the electrical characteristics of double-pole, double-break switch sites and to do so by a relatively simple folding operation, as described in U.S. Pat. No. 4,066,851. The present invention is directed to the achievement of a membrane switch device having individual double-pole, switches which is produced by silkscreening or otherwise applying conductors to one surface of a film and thereafter folding the film to produce the completed switch.

A membrane switch device in accordance with the invention is produced by applying to one surface of an elongated sheet of insulating film all of the switch conductors and switch electrodes required for two individual switch arrays. The conductors extend to a tail by means of which they can be connected to further circuit conductors. The elongated sheet of film is then folded along a first fold line which is adjacent to the tail and the tail is inserted through a slit in the film, the slit being midway between the ends of the elongated sheet of film. This first folding operation produces a first array of membrane switch sites. The remaining section of the film is also folded along a fold line to produce the second array of membrane switch sites and this second array is then folded as a unit so that it is parallel to the first array. Suitable separators are provided between the opposed surfaces of the film in the first array and in the second array. The switch sites in the two arrays are located such that after all of the folding operations have been carried out, the switch sites in the first array and in the second array are in alignment with each other. When the surface of the film is pressed at one of the switch sites, the electrodes in the first array and in the second array are moved towards each other so that two circuits are completed by the single switch closing operation.

DESCRIPTION OF THE DRAWINGS

FIGS. 1–4 show an elongated sheet of insulating film having conductors on one surface thereof, this film being folded as shown in FIGS. 2 and 3 to produce a membrane switch device as shown in FIG. 4.

PREFERRED EMBODIMENT OF THE INVENTION

A switch device 2, FIG. 4, in accordance with the invention, comprises two switch arrays 3, 6 which are folded against each other, as will be described below. The completed switch device 2 has a tail 4 extending from one of its edges and the conductors on the switch extend onto this tail as shown at 5, so that the switch electrodes and switch conductors can be connected to external circuitry. The conductors 5 may be soldered to further conductors or may be connected by means of a suitable electrical connector.

Figure 5:
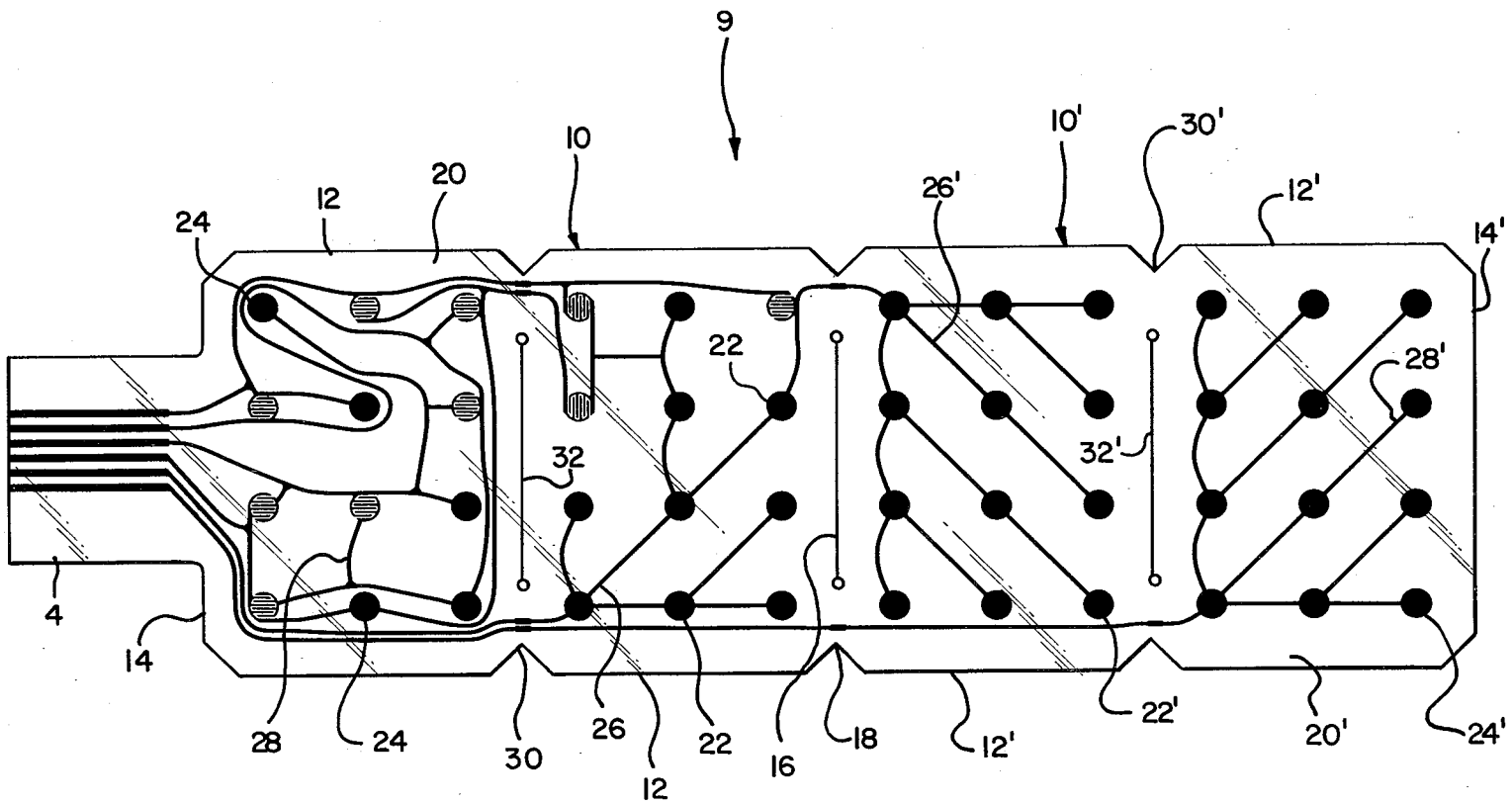
FIG. 5 is a plan view showing the location of the electrodes and conductors and the fold lines of the film.
Figure 6:
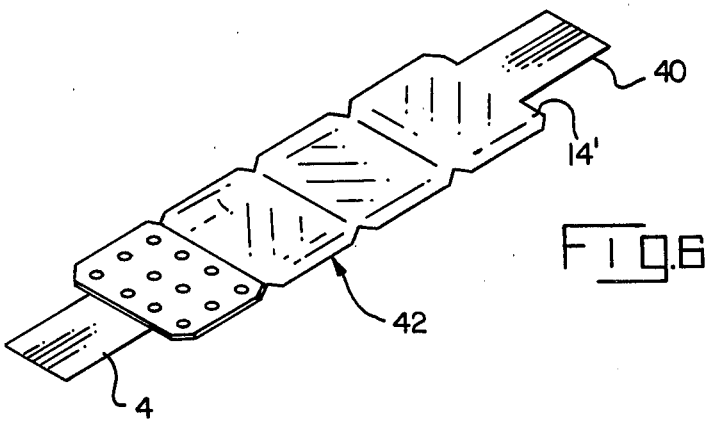
FIG. 6 is a view similar to FIG. 1 showing a sheet of film used to produce an alternative embodiment.
Figure 7:
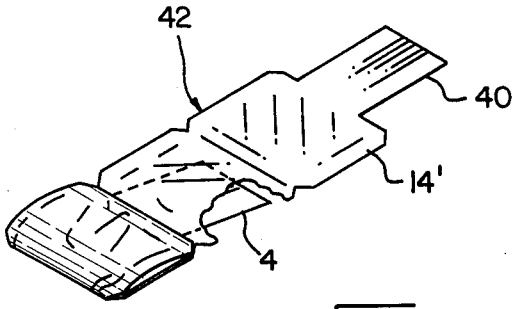
FIGS. 7 and 8 illustrate the folding of the film shown in FIG. 6.
Figure 8:
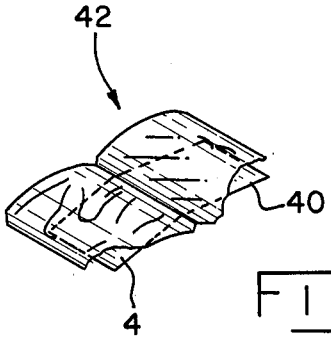

The structure of the switch device 2 is best understood from an explanation of the manner in which the completed device is produced from an elongated sheet of insulating film 9 which is shown in FIG. 5. The film may be of any suitable flexible plastic material, such as Mylar (polyester) and can be considered as comprised of two generally rectangular sections 10, 10' which are separated by a slit 16. The section 10 has parallel side edges 12, an end edge 14 from which the tail 4 extends, and an opposite end which is defined by the slit 16. The side edges are also notched at 18 in the vicinity of the slit 16 to facilitate folding, as will be described below. Conductors and electrodes are provided on the upper surface or first surface, as viewed in FIGS. 1 and 5, by silkscreening or otherwise printing conductive inks. Alternatively, these conductors may be electrodeposited by known techniques for producing electrodeposited conductors and switch electrodes on surfaces of films.

A first plurality of switch electrodes 22 and switch conductors 26 are provided on the surface 20 to the right of a fold line 32. A second plurality of switch electrodes 24 and switch conductors 28 are provided on the other side of the fold line 32 adjacent to the tail 4, the electrodes 22 and 24 being so located that when the section 10 is folded at the fold line 32, each electrode 24 will be opposed to, and in alignment with, an electrode 22.

The fold line 32 is defined by a slit in the film and by notches 30 in the side edges 12 and folding is carried out by simply folding the lefthand section, as viewed in FIG. 5, towards the righthand section so that the two sections have opposed surfaces on which the conductors are formed. The tail 4 is inserted through the slit 16 when this initial folding operation is carried out so that it extends beneath the remaining portion 10′ of the film, see FIG. 2.

A separator 34 is positioned between the opposed surfaces of the switch array 3 and has openings 36 therein which are in alignment with the electrodes 22, 24 to permit closing of the individual switches at the switch sites.

The portion 10′ of the elongated sheet 9 is in many respects similar to the portion 10 and is folded about a fold line defined by a slit 32′ and notches 30′ in the side edges 12′. The portion 10′ has electrodes 24′ which are on the righthand side of the fold line 32′ and electrodes 22′ on the lefthand side of this fold line. Conductors for the electrodes are also shown at 26′ and 28′.

The electrodes 22′, 24′ are opposed to each other after this second folding operation is carried out so that corresponding pairs of electrodes define an individual switch. A separator 34′ is also positioned between the surfaces of the second or additional switch device 6 when the folding operation is carried out on the section 10′. After the section 10′ has been folded as shown in FIG. 3, the switch device 6 is folded as a unit towards the switch device 3 so that the two switch arrays are now against each other in parallel relationship with the tail 4 extending from the slit 16 which defines one of the side edges of the switch device 2. It will be noted that all of the conductors 26, 28, 26′, 28′ extend across the fold lines on internal surfaces so that these conductors are never placed in tension as the result of the folding operation. This feature is of importance where the conductors are extremely thin and fragile, since they can be damaged if folded in a manner such that they are placed in tension.

Figure 9:
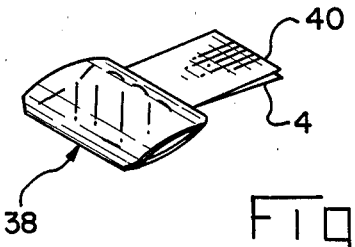
FIG. 9 is a perspective view of the alternative embodiment.

FIG. 9 shows an alternative embodiment having a second tail 40 extending from the switch device 38. The embodiment of FIG. 9 is produced generally as described above, but from a strip having a tail 40 extending from the end edge 14′ thereof. The tail 40 is inserted through the slit 16 when the section 10′ is folded, as described above, so that the tail 40 will be adjacent to and parallel to the tail 4. The conductors on the two tails 4, and 40 will be on the exposed surfaces which face in opposite directions so that connections can then be made to these conductors with a two row electrical connector, if desired.

It will be understood that the switch device 2 will ordinarily be contained in a suitable housing which may have graphics thereon above the individual switch position. The housing may have separate switch keys therein which, when pressed, close predetermined switches in the two switch arrays.

A double-pole switch device produced in accordance with the invention may be used for a wide variety of circuits and the particular circuits shown in FIG. 5 represent but one application and use of the principles of the invention. The particular circuits shown in FIG. 5 are used in a binary coded device and are advantageous in that malfunction is prevented as a result of the time delay between closing of two switches in the device. The circuit shown is arranged such that the input to the switch device produced when pressure is applied to one of the switch sites is delayed until both of the membrane switches at the switch site are closed. This prevents premature flow of input which might lead to operation of the circuitry in an unintended manner.

I claim:

1. A membrane switch device of the type comprising a first membrane switch having a sheet of flexible insulating film with side edges and first and second end edges, conductors and switch electrodes on one surface of said sheet, a first fold line located substantially midway between said end edges and extending normally of said side edges, said sheet being folded along said fold line so that said end edges coincide and said sheet is divided into two parallel sections with the first surface on each section opposed to the first surface on the other section and with said switch electrodes opposed to each other, first separator means between said opposed first surfaces which maintains said surfaces in spaced-apart relationship, said separator means permitting relative movement of said electrodes towards and against each other, and a tail extending from said first end edge, said conductors extending onto said tail, said switch device being characterized in that:

a second sheet of film is integral with said first sheet of film, said second sheet of film extending from said second end edge of said first sheet, a slit is provided between said first sheet and said second sheet, said tail being inserted through said slit, said second sheet of film having side edges and having an end edge which is remote from said first sheet, said second sheet being folded along a second sheet fold line which extends parallel to said first fold line to form a second membrane switch which is similar to said first membrane switch and which has opposed surfaces on which are provided second conductors and second opposed switch electrodes with a second separator means, said second membrane switch being folded as a unit along said second edge of said first sheet whereby said first switch and said second switch are in parallel planes.

2. A membrane switch device as set forth in claim 1, said opposed surfaces of said second membrane switch continuing from, and being an extension of, said one surface of said first sheet.

3. A membrane switch device as set forth in either of claims 1 or 2, a second tail extending from said end edge of said second sheet, said second tail being inserted through said slit and being beside said tail of said first sheet.

4. A membrane switch device as set forth in claim 3, said switch electrodes on said second membrane switch being aligned with said switch electrodes on said first membrane switch.

5. A membrane switch device as set forth in claim 4, said side edges being parallel, said end edges extending normally of said side edges.

6. A membrane switch device as set forth in claim 1, said second conductors extending to and across said opposed first surfaces of said first switch and onto said tail.

7. A membrane switch device as set forth in claim 6, said switch electrodes on said second membrane switch being in alignment with said switch electrodes in said first membrane switch.

8. A membrane switch device as set forth in claim 7, said separator means for said first membrane switch and said separator means for said second membrane switch each comprising a sheet of insulating film having openings therein in alignment with said switch electrodes.

* * * * *